US006322096B2

(12) United States Patent
Porte

(10) Patent No.: US 6,322,096 B2
(45) Date of Patent: Nov. 27, 2001

(54) DEVICE FOR FIXING A BOOT ONTO A SPORTING ARTICLE

(75) Inventor: Pierre Alain Porte, Seynod (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/797,729

(22) Filed: Mar. 5, 2001

Related U.S. Application Data

(6362) Continuation of application No. 09/147,702, filed as application No. PCT/FR97/01507 on Aug. 20, 1997.

(30) Foreign Application Priority Data

Aug. 21, 1996 (FR) ..... 96 10457

(51) Int. Cl.[7] ..... A63C 9/00; A63C 9/08; A63C 9/10; B62B 9/04

(52) U.S. Cl. ..... 280/617; 280/14.2; 280/618; 280/634

(58) Field of Search ..... 280/14.2, 617, 280/618, 634, 635

(56) References Cited

U.S. PATENT DOCUMENTS

| | | | |
|---|---|---|---|
| 3,992,037 | 11/1976 | Frechin | 280/618 |
| 4,505,493 | 3/1985 | Gustavsson | 280/617 |
| 4,846,492 | 7/1989 | Bataille | 280/613 |
| 5,044,654 | 9/1991 | Meyer | 280/14.2 |
| 5,354,088 | 10/1994 | Vetter et al. | 280/618 |
| 5,544,909 | 8/1996 | Laughlin et al. | 280/617 |
| 5,553,883 | 9/1996 | Erb | 280/618 |
| 5,577,755 | 11/1996 | Metzger et al. | 280/618 |
| 5,577,756 | 11/1996 | Caron | 280/617 |
| 5,697,631 | 12/1997 | Ratzek et al. | 280/617 |
| 5,762,358 | 6/1998 | Hale | 280/618 |
| 5,876,045 | 3/1999 | Acuna, Jr. | 280/14.2 |
| 5,897,128 | 4/1999 | McKenzie et al. | 280/14.2 |
| 5,947,508 | 9/1999 | Graf et al. | 280/617 |
| 5,954,358 | 9/1999 | Bejean et al. | 280/14.2 |
| 5,971,422 | 10/1999 | Anderson et al. | 280/14.2 |
| 6,017,042 | 1/2000 | Paris | 280/14.2 |

FOREIGN PATENT DOCUMENTS

| | | |
|---|---|---|
| 321781 | 4/1975 | (AT) . |
| 2359309 | 6/1975 | (DE) . |
| 2749904 | 5/1979 | (DE) . |
| 29601721 | 7/1996 | (DE) . |
| 29608660 | 9/1996 | (DE) . |
| 2483793 | 12/1981 | (FR) . |
| WO93/14835 | 8/1993 | (WO) . |

*Primary Examiner*—Brian L. Johnson
*Assistant Examiner*—Joselynn Sliteris
(74) *Attorney, Agent, or Firm*—Greenblum & Bernstein P.L.C.

(57) ABSTRACT

A device for fixing a boot onto a sporting article, such as a snowboard. The device includes a base, front and rear boot retaining assemblies having abutment surfaces, front and rear guides, and mechanisms for releasing the boot, as well as a structural arrangement to attach the device onto the sporting apparatus. The device also includes the boot with its sole capable of being supported on the base, the boot having front and rear catching members. The front and rear catching members are applied respectively to the front abutment surfaces and the rear guides when the boot is first put on, then the rear catching members follow a trajectory that modifies the distance which separates them from the front catching members to come to rest on the rear abutment surfaces when the boot is completely on.

24 Claims, 5 Drawing Sheets

DEVICE FOR FIXING A BOOT ONTO A SPORTING ARTICLE

CROSS-REFERENCE TO RELATED APPLICATIONS

This application is a continuation of pending U.S. patent application Ser. No. 09/147,702, filed as the U.S. national phase of international application No. PCT/FR97/01507, the international application having been filed on Aug. 20, 1997, not having published in English, the disclosure of U.S. patent application Ser. No. 09/147,702 hereby incorporated-by-reference thereto in its entirety and the priority of which is claimed under 35 USC 120.

This application is also based upon French Application No. 96 10457, filed on Aug. 21, 1996, the disclosure of which is hereby incorporated by reference thereto in its entirety and priority of which is claimed under 35 USC 119.

BACKGROUND OF THE INVENTION

1. Field of the Invention

The present invention is related to a device for fixing the foot onto a sporting article of the snowboard, skate board or roller skate type, of the type comprising a boot, a base, catching members, rear ankle retaining assemblies as well as means for attaching it onto the selected sporting article.

2. Description of Background and Relevant Information

Such fixing devices intended to be mounted onto sporting articles such as snowboards are known, and they comprise a base, equipped with vertical retaining means for the boot, that rests directly on top of the sporting article, and at its center, it has a circular recess, along the upper edges of which is applied a supporting disc which is itself affixed onto the sporting article by means of screws. The upper edges of the circular opening of the base as well as the lower edges of the supporting disc have notched surfaces that cooperate with each other to allow, when the screws are loosened, the orientation of the foot to be adjusted with respect to the axis of the sporting article so that the device can be adapted to various practices and to a variety of users. The means for retaining the boot on the base are constituted of straps, as is the case, for instance, with snowboard bindings for flexible boots, also well known by the term shells, the straps being generally two in number and positioned on top of the boot, one near the instep and the other near the toe, each such strap generally comprising two separate sections, each of the sections being fixed by one of its ends to the base by virtue of anchoring means, constituted, for example, of screws, that cooperate with the drill holes present in the two vertical walls extending the base on either side of the foot. The strap sections can be connected to each other via a tightening system borne by their other ends and are substantially similar to a hook used for tightening alpine ski boots, which are also well-known.

Such a device describing the prior state of the art is disclosed, for example, in the patent document WO 93/14835. It requires manual intervention by the user when the boot is put on or taken off, the user being forced to bend in order to tighten the two straps on top of the boot once it has been positioned on the base. In addition, such a device forces the user to take off the boot and use a screwdriver if it is desired to change the angular adjustment of the bindings.

Other devices, such as described in the patent document WO 96/05894, for example, add, beneath the sole of the boot, a rigid plate that projects on either side of the boot or therebelow and cooperates with the retaining means affixed to the sporting article. Although the configuration of these catching members provides a simple solution to the problem of putting on the boot, which can thus be done without using the hands, the presence of a plate beneath the sole causes the boot to stiffen, thereby adversely impacting its comfort, especially while walking.

SUMMARY OF THE INVENTION

It is an object of the invention to improve the ergonomics of devices such as described in the patent document WO 93/14835, by allowing the boot to be put on more quickly and with less effort, while at the same time retaining all the flexibility of the sole. In addition, the invention allows the user to change the orientation of the foot with respect to the sporting article without having to remove the boot or use tools.

To this end, in accordance with an embodiment of the invention, such a fixing device comprises a base, front and rear retaining assemblies, front and rear guides, as well as mechanisms for releasing the foot, mechanisms for fixing it onto the sporting article, and a boot whose sole can rest on the base, and equipped with front and rear catching members affixed to the boot. When the boot is put on, the front catching members of the boot rest on the front retaining assemblies in such a way that the boot can no longer be lifted or translated towards the rear. To this end, the front retaining assemblies have U-shaped recesses, open towards the front, that receive the front catching members of the boot. Such members consist of projections that extend perpendicularly with respect to the axis of the foot in the area of the sole and beyond the edge thereof, so that they extend beyond the foot on either side. The rear catching members are then applied on the rear guides, and they follow, due to the pressure of the heel of the boot, a trajectory during which the distance separating them from the front catching members increases substantially, thus resulting in an extension of the sole; thereafter, they are applied onto the rear retaining assemblies when the heel of the sole comes into contact with the base. In this so-called locking position, the sole returns to its original length.

To this end, between its front and rear catching members, the sole of the boot has a connecting element present in the core of the sole, or constituted thereof and fixed to each of the catching members that are capable of being deformed substantially and elastically, when a stress is applied thereupon along a longitudinal axis.

The rear catching members consist of an axis crossing the sole and bearing, on either side, wheels that are free to rotate. These wheels rotate, when the boot is put on, along a guide section borne by the rear guides.

According to another characteristic of the device, the releasing mechanism consists of at least one mobile element having limited clearance whose movement, which is caused manually by the user when he/she wants to remove his/her boot, affects at least one of the catching members, so as to elongate the sole to allow the catching members of the sole to come out from the base retaining assemblies.

According to another characteristic of the device of the invention, a structural arrangement can be provided on the base for adjusting the orientation of the foot with respect to the axis of the sporting article.

According to another characteristic of the device, the base has an arrangement to block the orientation of the foot, consisting of a latch equipped with an index that is translationally mobile inside the latch, elastic means to return the index to the lowered position, and an index manipulating member. On the other hand, the attachment member on the sporting article has openings capable of receiving the index so as to prevent the rotation of the base. A groove on the upper surface of the latch can receive the index manipulating member. Thus, when the manipulating member is engaged in the groove, the index is in the lowered position and it blocks the rotation of the base by being engaged in one of the openings of the attachment member. When the user wishes to modify the orientation of the foot, he/she pulls on the manipulating member, and can thus, without having to take off the boot, rotate the foot about a vertical axis and then block it into the more appropriate angular position.

BRIEF DESCRIPTION OF THE DRAWINGS

The invention, its advantages and other characteristics will be better understood from the following description, with reference to the annexed schematic drawings, that illustrate, as a non-restrictive example, one embodiment of the invention.

FIG. 3 is a side view of the device when the boot is put on.

DETAILED DESCRIPTION OF THE INVENTION

Figure 1:
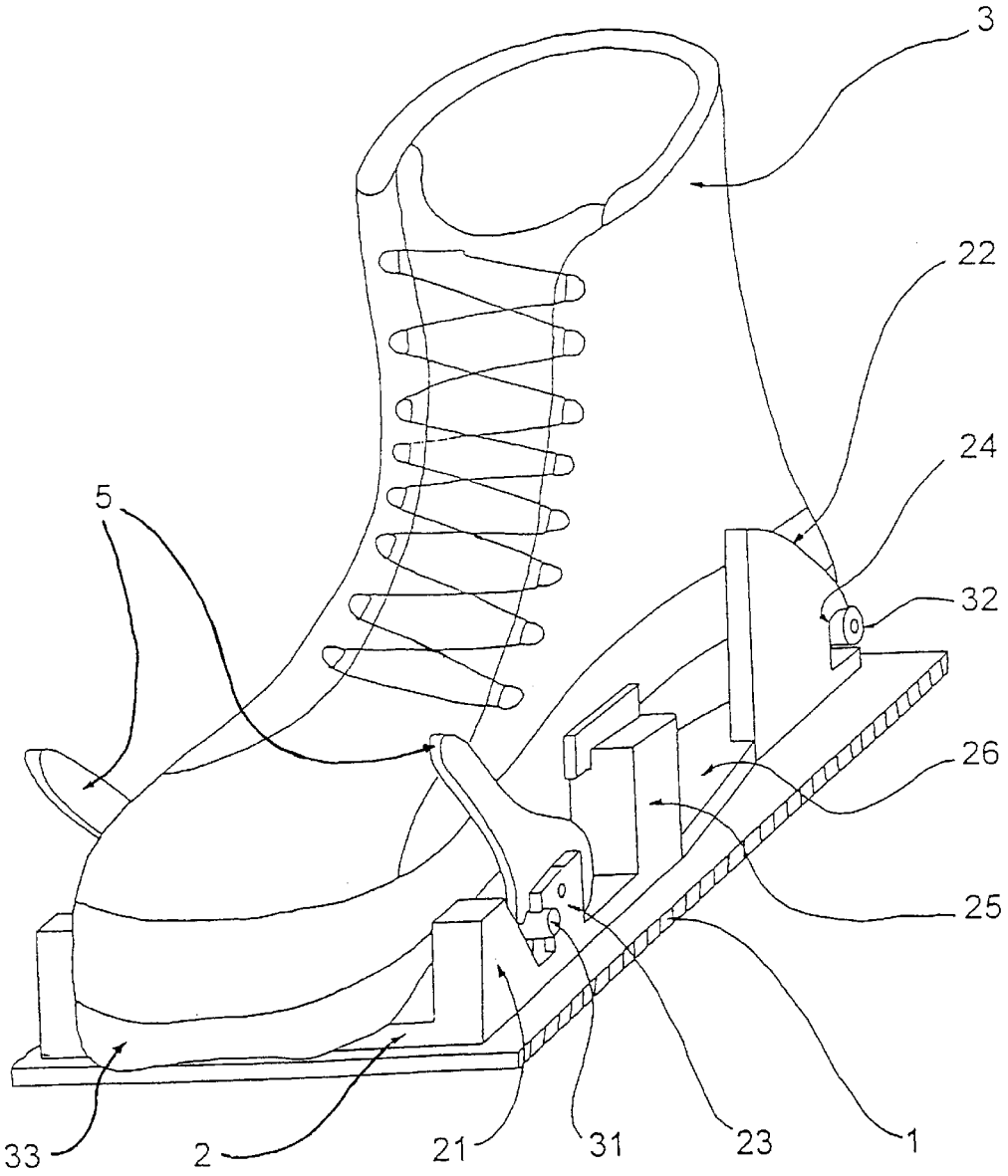
FIG. 1 is a perspective view of the entire device.
Figure 2:
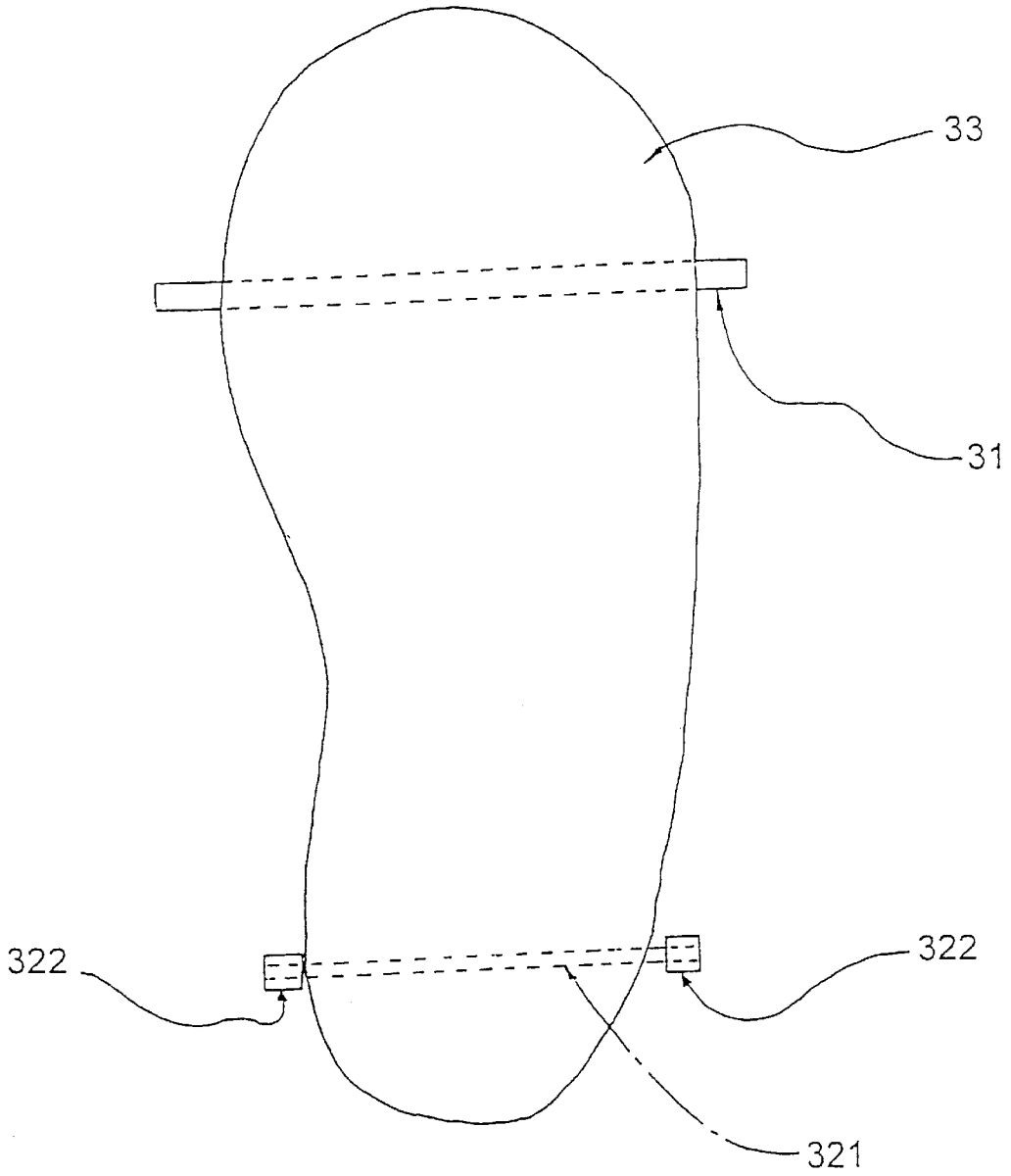
FIG. 2 is a bottom view of the sole of the boot.
Figure 3:
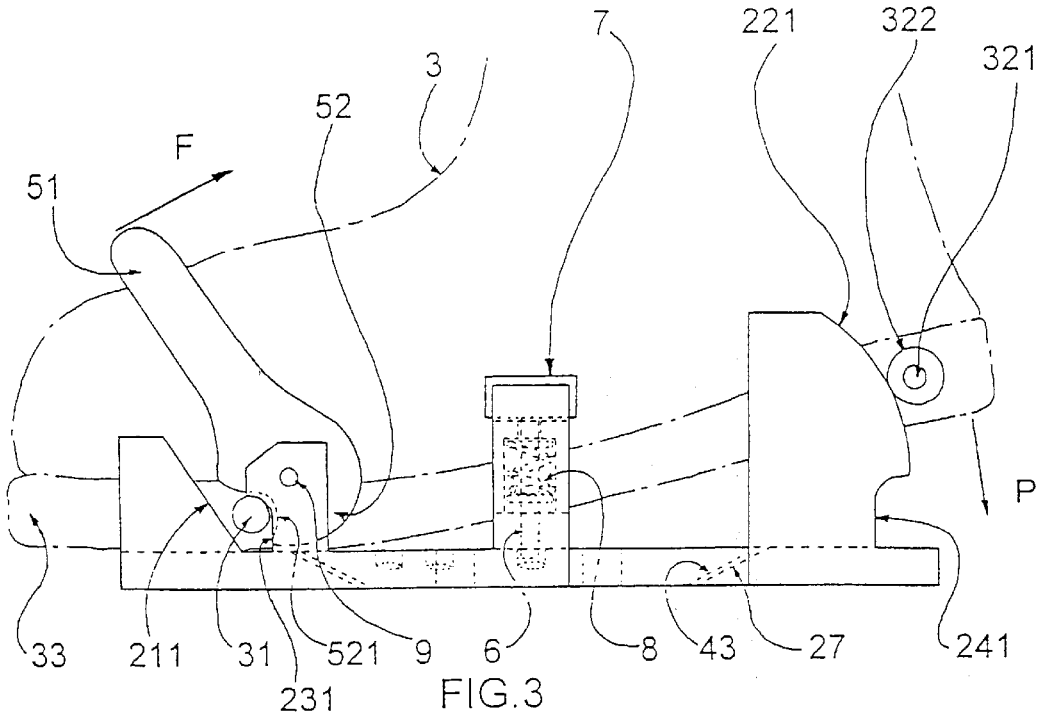
Figure 4:
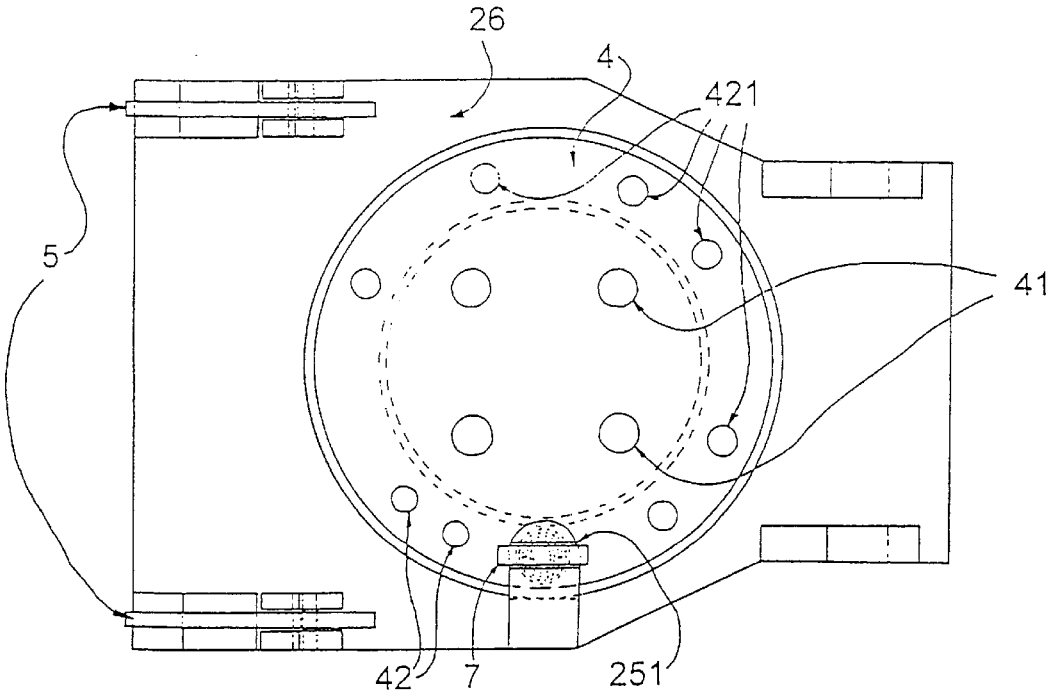
FIG. 4 is a top view of the base and the attachment members on a sporting article.

With reference to FIGS. 1, 2, 3 and 4, the device comprises a base 2, fixed onto the sporting article 1, such as a snowboard, by virtue of an attachment member 4, and a boot 3.

The base 2 has front guide and retaining assemblies 21 and 23, rear guide and retaining assemblies 22 and 24, an arrangement 25 for blocking the orientation of the foot, releasing mechanisms 5, a support plate 26 on which the boot 3 is supported, and carries ankle retaining elements at the rear, not represented in the drawings but complying in every way to the prior state of the art, as disclosed in the document WO 93/14835.

In the area of its sole 33, the boot 3 has front 31 and rear 32 catching members.

The support plate 26 is substantially rectangular and has a length that is slightly less than the width of the sporting article 1, and a width that is greater than that of the boot 3. It rests on the sporting article 1 via its lower surface, and at its center, it has a wide circular slot whose upper edges form a bevel 27.

Each of the front catching members 31 of the boot 3 is constituted of a cylindrical shaft crossing the sole 33 of the boot 3 along a horizontal and transverse axis near the first front quarter of the total length of the sole 33 and extending along either side thereof.

The front guides 21 are located on either side of the front half of the boot 3 and each forms, via its upper and rear surfaces, a section 211 that is inclined from the front to the rear and from the top to the bottom. The front retaining assemblies 23 are located in alignment with the guides 21, and each consists of two vertical and parallel walls that have a recess, substantially in the shape of a frontwardly open U, whose lower portion constitutes an abutment surface 231, adapted to receive the front catching members 31 of the boot 3. The front guides 21 are substantially higher than the retaining assemblies 23, such that the front catching members 31 of the boot 3 can easily be applied therein when the toe moves towards the front. Moreover, the inclined section 211 causes the front catching members 31 to be engaged in the front retaining assemblies 23 and then rest against the abutment surfaces 231, a position in which the toe of the boot 3 can neither be lifted nor translated towards the rear. The groove separating the two vertical walls receives the releasing mechanisms 5.

The releasing mechanisms consist of two levers, rotationally mounted about the transverse axles 9 borne by the front retaining assemblies 23 on either side of the foot. Each of these levers has a short arm 52 intended to rest against the front catching members 31 of the boot 3 and a long arm 51 extending upwardly and frontwardly when the device is locked, and which the user can activate along direction F when he/she wants to remove the boot. The short arm 52 has a section 521 comprising a recess capable of driving the catching members 31 of the boot 3 towards the front, when the lever rotates about its axle 9 in a clockwise direction. To this end, the axle 9 extends along a horizontal plane located above the abutment surface 231. The action of the releasing mechanisms 5 thus permits the catching members 31 of the boot 3 to be removed from the retaining assemblies 23 of the base 2.

The rear guides 22 are located along the upper surface of the support plate 26 and are affixed thereto. They extend symmetrically with respect to a vertical longitudinal plane, on either side of the rear half of the boot 3, and each of them consists of a vertical wall whose upper and rear surfaces form a specific guide section 221, substantially inclined from the front to the rear and from the top to the bottom, whose distance from the points at the front abutment surfaces 231 increases progressively, along a regular curve, to reach a maximum that is slightly greater than the distance separating the front 31 and rear 32 catching members of the boot 3 at rest, and then rejoins the rear retaining assemblies 24. Each of these assemblies consists of a recess, in the shape of a rearwardly open U made in the vertical wall, whose base forms an abutment surface 241 designed to receive a respective one of the rear catching members 32 of the boot 3, when the heel of the boot 3 comes into contact with the support plate 26.

Each of the rear catching members 32 of the boot 3 are constituted of a horizontal axle 321 crossing the sole 33 of the boot 3 perpendicularly to the axis of the foot, in the area of the last rear quarter of the total length of the sole 33 and ending on either side of the foot via two cylindrical projections each bearing a wheel 322 that can rotate freely about the axle 321.

When the front catching members 31 rest against the abutment surfaces 231, a pressure P from the user on the heel of the boot 3 applies the wheels 322 onto the guide section 221 on which they roll from the top to the bottom and from the front to the rear, thus forcing the sole 33 of the boot 3 to be progressively elongated. Then, the wheels 322 become engaged in the rear retaining assemblies 24 and rest against the abutment surfaces 241 while allowing the sole 33 to substantially revert to its original length via elasticity. To this end, the distance separating the front 231 and rear 241 abutment surfaces is substantially equal to the distance separating the front 31 and rear 32 catching members of the boot 3.

The attachment member 4 for attaching the device of the invention onto the sporting article 1 consists of a supporting disc, the lower surface edges of which have a bevel 43, such bevel being applied on the bevel 27 of the support plate 26, thus allowing the base 2 to be kept aligned with respect to the attachment member 4. On the other hand, the attachment member 4 has drilled holes 41 for the passage of the binding screws.

Tightening these screws ensures the vertical retention of the base 2, but it still allows the base 2 to rotate about a vertical axis by the friction between the bevel 43 of the attachment member 4 and the bevel 27 of the base 2 and between the bottom of the support plate 26 and the top of the sporting article 1.

Furthermore, the supporting disc of the attachment member 4 has a series of openings 42 and 421 distributed along a peripheral circumference, and located at different angular positions with respect to the center of the disc, depending on the user's convenience, and cooperating with the arrangement 25 for blocking the orientation of the foot.

The latter consists of a latch borne by the top of the support plate 26, in the middle of its length, one of its ends being affixed to such plate whereas the other extends above the central slot. It comprises a vertical bore, open at the bottom and closed on the top, whose axis cuts the circumference of the supporting disc along which the openings 42 and 421 are made. The upper surface of the latch comprises a vertical drill hole ending in the bore and co-axial thereto, as well as a groove 251 parallel to the axis of the foot and centered along the axis of the bore. An index 6 is vertically translated inside the bore. It moves from a raised position, in which its lower end is in a horizontal plane located above the upper surface of the supporting disc of the attachment member 4, to a lowered position, towards which it is returned via a compression spring 8, and in which it can be engaged in the openings 42. The index 6 is constituted of a shaft that has a flange in its lower portion, and a manipulating member 7 at its upper end that can be engaged in the groove 251. The compression spring 8 rests between the top of the flange and the base of the bore, around the index 6, inside the bore.

The index 6 blocks the rotation of the base 2 when its lower end is engaged into an opening 42. If one wants it to rotate freely about itself, for example in order to bring the front foot in the axis of the sporting article 1, and the rear foot has been unshod in order to practice the technique of scooting, the manipulating member 7 need only be pulled upwardly and then rotated by a quarter of a revolution so that it abuts against the upper surface of the latch without being able to be engaged in the groove 251, thus preventing the index 6 from going back down and keeping the spring 8 compressed.

The blocking arrangement 25 is preferably located along the inner surface of the foot so as to be housed in the hollow left by the plantar arch in this area. The diameter of the attachment member 4 is thus enough to exceed the sole 33 of the boot 3 in this area.

This device is compatible with various means for retaining the ankle towards the rear. They can be external, i.e., borne by the base 2, as described in the patent document WO 93/14835, or they can be internal and consist of stiffening means borne by the upper of the boot 3.

The length by which the catching members 31 and 32 exceed the sole 33 of the boot does not exceed 1.5 cm so that they do not impede walking. According to a preferred embodiment, the front 31 catching members of the boot 3 may also not exceed the sole 33. In this case, adequate recesses made in such sole beneath the foot make them accessible to the retaining assemblies 23, which are no longer located on each side of the foot but underneath it.

One embodiment is especially intended for snowboarding, a sport in which a given user is not called upon to vary the orientation of his/her foot by more than 90° during any session. While adjusting the orientation of the foot, in order that the index 6 does not accidentally become engaged in the openings 42 that do not correspond to the adjustment desired by the user, the supporting disc of the attachment member 4 only has three openings 42 per each 90° angle sector. It is possible to envision, for example, an opening that allows the foot to be oriented substantially perpendicularly to the sporting article, so as to promote lateral stability and acrobatic maneuvers, another opening could be intended for practicing scooting by placing the front foot in the axis of the sporting article, and an intermediate opening could be used when speed is the primary factor. Additionally, in order to increase the number of possible adjustments, each 90° angle section of the supporting disc of the attachment member 4 can have openings 421 located at different angular positions, such that when the supporting disc is unscrewed, a 90° rotation thereof allows for new adjustments. According to another embodiment, the supporting disc does not comprise any opening except for the binding drill holes 41, but has an angular gradation distributed along 360°, the drilling of the openings 42, 421 being left at the user's discretion.

According to another embodiment, the sole 33 of the boot 3 comprises in its core, an elastic element connecting the front 31 and rear 32 catching members to each other. The elastic element is intended to control the tension that is exerted when the boot is put on.

Figure 5:
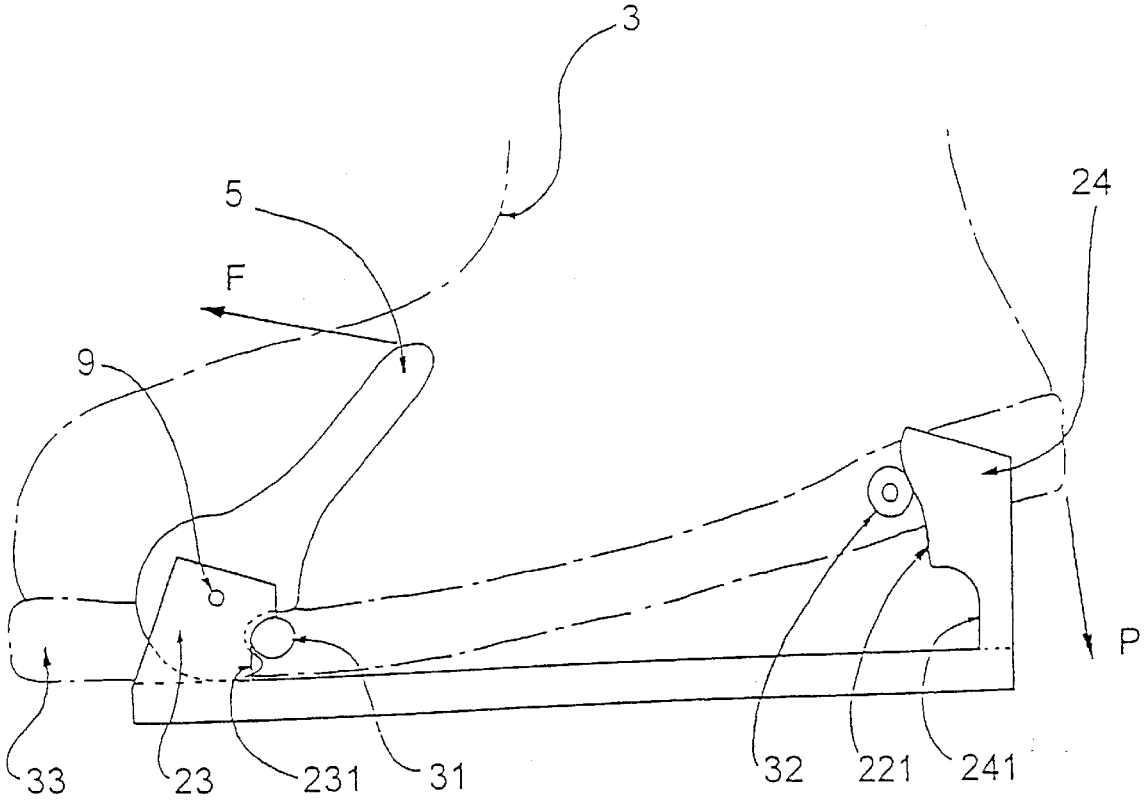
FIGS. 5, 6 and 7 represent other possible embodiments of the invention.

According to FIG. 5 which represents another embodiment, the front 23 and rear 24 retaining assemblies cooperate to compress the sole 33 under the effect of a vertical pressure P on the heel of the boot 3. To this end, each of the front retaining assemblies 23 has a substantially U-shaped recess in its rear surface, the recess being open towards the rear and its base having an abutment surface 231 intended to receive a respective one of the front catching members 31 of the boot 3. Furthermore, the rear retaining assemblies 24 have, on their frontal surfaces, a guide section 221 that the rear catching members 32 of the boot 3 cross from top to bottom, and whose distance from the points of the front abutment surface 231 reduces progressively to a reach a minimum that is substantially less than the distance separating the front 31 and rear 32 catching members of the boot 3 at rest. This section rejoins a U-shaped recess, open towards the front, whose base has an abutment surface 241 intended to receive the rear catching members 32 of the boot 3. Each of the releasing assemblies 5 consists of a lever that is mobile about an axle 9 whose lower end rests against a front catching member 31 and pushes it back when the user exerts a force F on its other end.

Figure 6:
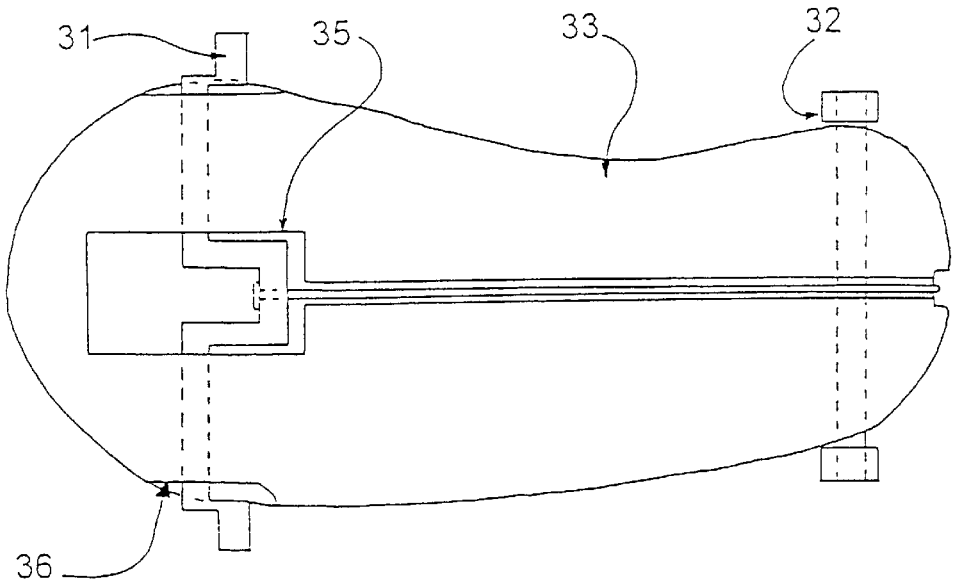
Figure 7:
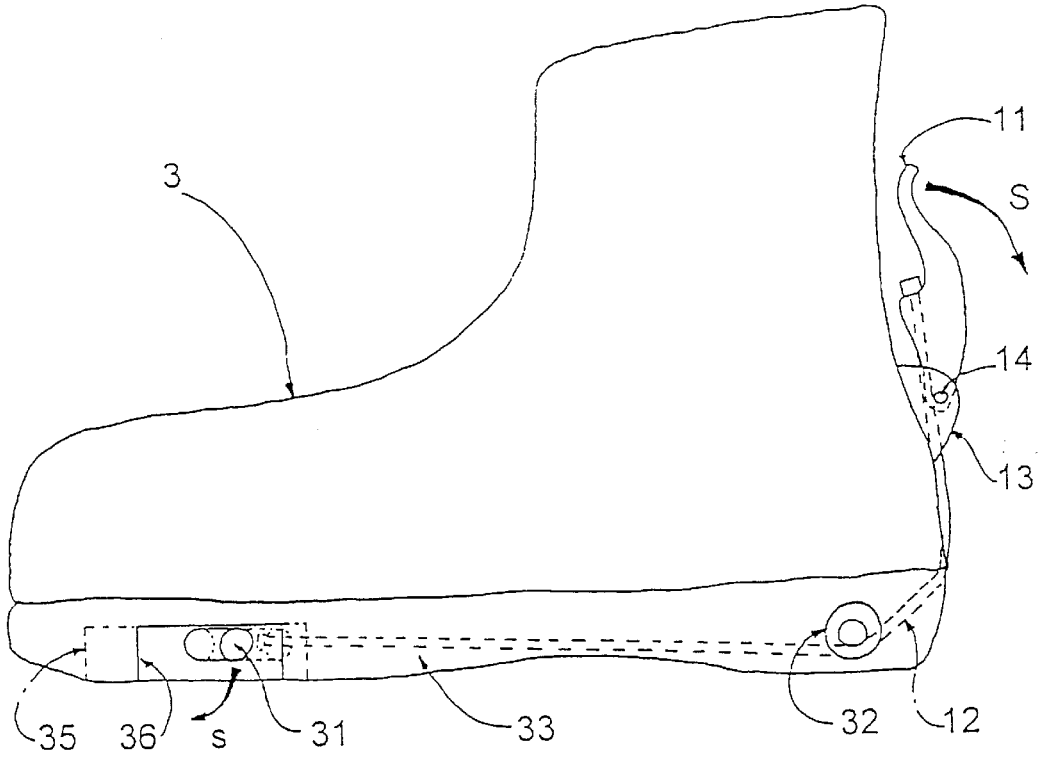

FIGS. 6 and 7 represent a boot intended to rest on a base as described in FIG. 1, but do not comprise the releasing assemblies 5. These assemblies are replaced by a device borne by the sole 33 of the boot 3. The sole 33 comprises a central recess 35 extended via a groove 36 receiving a flexible element 12 of a steel cable or other type, connecting the front catching members 31 of the boot 3 to a lever 11 mobile about an axle 14 borne by a support member 13 affixed to the rear surface of the upper of the boot 3. The front catching members 31 of boot 3 consist of a crank that can be rotated about an axis crossing the sole perpendicularly to the foot, and whose projections on either side of the sole 33 are off-centered with respect to the rotational axis and accessible by virtue of groove 36 made in the sole 33. The flexible element 12 is connected to the catching members by their central portion which is also off-centered. According to this embodiment, when the lever 11 is in the raised position, the flexible element 12 is tensed and keeps the front catching members 31 at the rear. In this position, the user can put on the boot by engaging such catching members 31 into the retaining assemblies 23, and then by lowering his heel so as to lock the rear catching members 32 in the rear retaining assemblies 24. To take off the boot, the user activates the lever 11 along the direction S, thus resulting in the relaxation of the flexible element and enabling the front catching members to rotate about their axes in the direction S. Thus, the user can withdraw his/her foot to take out the rear catching members 32 from the rear retaining assemblies 24.

What is claimed is:

1. A device for fixing onto a sporting article a boot having a sole and front and rear catching members, said device comprising:

a base adapted to be affixed to the sporting article and adapted to support the sole of the boot;

an attachment member to fix said base to the sporting article;

a front retaining assembly and a rear retaining assembly for retaining the boot on said base, each of said front and rear retaining assemblies comprising:

abutment surfaces for engagement with the catching members of the boot; and guides for engagement with the catching members of the boot;

mechanisms for releasing the catching members of the boot from said abutment surfaces;

said front abutment surfaces of said front retaining assembly being adapted to receive the front catching members of the boot upon initial placement of the boot into the device; and said rear guides of said rear retaining assembly being adapted to receive the rear catching members of the boot upon said initial placement of the boot into the device and, upon exertion of a pressure on a heel of the boot, said guides defining a path of movement of the rear catching members of the boot for changing a distance separating the front and rear catching members, said path of said rear guides leading to said rear abutment surfaces, said rear abutment surfaces being adapted to engage the rear catching members upon engagement of the heel of the sole of the boot with said base.

2. A device according to claim 1, wherein:

each of said front and rear retaining assemblies defines a U-shaped recess, each of said recesses including a lower portion, said lower portion of each of said recesses being defined by respective ones of said front and rear abutment surfaces, said front and rear abutment surfaces being separated by a distance substantially equal to a distance separating the front and rear catching members of the boot at rest, and resisting, when the catching members are placed in engagement with said abutment surfaces, a change in the distance separating the front and rear catching members.

3. A device according to claim 1, wherein:

each of said rear guides has guide sections adapted to receive the rear catching members of the boot in the form of wheels.

4. A device according to claim 1, wherein:

said releasing mechanisms comprise movable elements for applying a manual force on the front catching members for removing the boot by changing the distance separating the front and rear catching members of the boot in the same direction as the distance separating the front and rear catching members of the boot is changed upon said initial placement of the boot into the device.

5. A device according to claim 4, wherein:

said direction the distance separating the front and rear catching members of the boot is changed is a direction reducing said distance.

6. A device according to claim 4, wherein:

said direction the distance separating the front and rear catching members of the boot is changed is a direction increasing said distance.

7. A device according to claim 1, further comprising:

a structural arrangement, fixed with respect to said base, for blocking an adjustment of an orientation of the boot with respect to the sporting article, said structural arrangement comprising a latch equipped with an index, said index being translationally movable inside said latch, elastic means for returning said index to a lowered position, a manipulating member for said index, and an attachment member for attaching the device onto the sporting article;

said attachment member having openings adapted to receive said index to prevent said base from rotating.

8. A device according to claim 7, wherein:

said latch comprises an upper surface and a groove in said upper surface for engagement with said manipulating member.

9. A device according to claim 1, wherein:

said attachment member extends beyond an edge of the sole of the boot, at least on an inner side of a plantar arch of the sole, with the boot resting upon said base.

10. A boot in combination with a device for fixing the boot onto a sporting article, said combination comprising:

a boot having a sole, said sole including front and rear catching members;

a device for fixing said boot onto the sporting article, said device comprising:

a base adapted to be affixed to the sporting article and adapted to support said sole of said boot;

an attachment member to fix said base to the sporting article;

a front retaining assembly and a rear retaining assembly for retaining said boot on said base, each of said front and rear retaining assemblies comprising abutment surfaces for engagement with said catching members of said boot, and guides for engagement with said catching members of said boot;

mechanisms for releasing said catching members of said boot from said abutment surfaces;

said front abutment surfaces of said front retaining assembly receiving said front catching members of said boot upon initial placement of said boot into the device; and said rear guides of said rear retaining assembly receiving said rear catching members of said boot upon said initial placement of said boot into the device and, upon exertion of a pressure on a heel of said boot, said guides defining a path of movement of said rear catching members of said boot for changing a distance separating said front and rear catching members, said path of said rear guides leading to said rear abutment surfaces, said rear abutment surfaces engaging said rear catching members upon engagement of said heel of said sole of said boot with said base.

11. The combination according to claim 10, wherein:

each of said front and rear retaining assemblies defines a recumbent U-shaped recess, each of said recesses including a lower portion, said lower portion of each of said recesses being defined by respective ones of said front and rear abutment surfaces, said front and rear abutment surfaces being separated by a distance substantially equal to a distance separating said front and rear catching members of said boot at rest, and resisting, when said catching members are placed in engagement with said abutment surfaces, a change in the distance separating said front and rear catching members.

12. The combination according to claim 10, wherein:

said front catching members of said boot comprise projections extending substantially perpendicularly to a longitudinal axis of said sole, said projections being engageable with said abutment surface; and said rear catching members comprise an axle extending transversely of said sole, on opposite sides of said sole said axle bearing freely rotatable wheels.

13. The combination according to claim 12, wherein:

each of said rear guides has guide sections adapted to receive said wheels of said rear catching members of said boot.

14. The combination according to claim 10, further comprising:

a connecting element extending in said sole of said boot, between said front and rear catching members, said connecting element being fixed to each of said catching members and being elastically and substantially deformable upon application of a force along a longitudinal axis.

15. The combination according to claim 10, wherein:

said releasing mechanisms comprise movable elements for applying a manual force on said front catching members for removing said boot by changing the distance separating said front and rear catching members of said boot in a direction common with a direction the distance separating said front and rear catching members of said boot are changed upon said initial placement of said boot into the device.

16. The combination according to claim 15, wherein:

said direction the distance separating said front and rear catching members of said boot is changed is a direction reducing said distance, thereby compressing said sole between said front and rear catching members.

17. The combination according to claim 15, wherein:

said direction the distance separating said front and rear catching members of said boot is changed is a direction increasing said distance, thereby extending said sole between said front and rear catching members.

18. The combination according to claim 10, further comprising:

a structural arrangement, fixed with respect to said base, for blocking an adjustment of an orientation of said boot with respect to the sporting article, said structural arrangement comprising a latch equipped with an index, said index being translationally movable inside said latch, elastic means for returning said index to a lowered position, a manipulating member for said index, and an attachment member for attaching the device onto the sporting article;

said attachment member having openings adapted to receive said index to prevent said base from rotating.

19. The combination according to claim 18, wherein:

said latch comprises an upper surface and a groove in said upper surface for engagement with said manipulating member.

20. The combination according to claim 10, wherein:

said attachment member extends beyond an edge of said sole of said boot, at least on an inner side of a plantar arch of said sole, with said boot resting upon said base.

21. The combination according to claim 10, further comprising a sporting article.

22. The combination according to claim 21, wherein:

said sporting article comprises a snowboard, roller skate, or skateboard.

23. The combination according to claim 10, wherein:

said sole of said boot is flexible to facilitate said changing of said distance separating said front and rear catching members.

24. The combination according to claim 10, wherein:

said sole of said boot has a flexibility allowing a front part of said sole to be in engagement with an upper surface of said base as a heel of said sole is raised from said upper surface of said base.

* * * * *